US006104131A

United States Patent [19]

Clerc

[11] Patent Number: 6,104,131

[45] **Date of Patent: *Aug. 15, 2000**

[54] MICROTIP CATHODE WITH RESISTIVE LAYER

[76] Inventor: Jean-Frédéric Clerc, 18, Avenue de l'Europe, 38120 Saint Egreve, France

[ * ] Notice: This patent is subject to a terminal disclaimer.

[21] Appl. No.: 08/951,780

[22] Filed: Oct. 16, 1997

Related U.S. Application Data

[63] Continuation of application No. 08/511,261, Aug. 4, 1995, Pat. No. 5,808,403.

[30] Foreign Application Priority Data

Aug. 5, 1994 [FR] France ..... 94 09925

[51] Int. Cl.[7] ..... H01J 1/30; H01J 19/24

[52] U.S. Cl. ..... 313/336; 313/309

[58] Field of Search ..... 313/309, 351, 313/336, 495, 496, 497

[56] References Cited

U.S. PATENT DOCUMENTS 5,451,830 9/1995 Huang ..... 313/309

*Primary Examiner*—Michael H. Day

*Attorney, Agent, or Firm*—Arthur L. Plevy; Buchanan Ingersoll PC

[57] ABSTRACT

A cathode (1) includes a substrate (10), a resistive layer (11) disposed on the substrate (10); at least one cathode conductor (13), and microtips (2) disposed on the resistive layer (11), wherein the cathode conductor (13) has circular wells (17) in the middle of each of which a microtip (2) is disposed, whereby the microtips (2) are electrically isolated from the cathode (13) by a constant access resistance.

6 Claims, 5 Drawing Sheets

11
10

19
11
10

13
19
11
10

18
13
19
11
10

15
15
15
18
13
19
11
10

15
15
15
18
13
19
11
10

16
15
15
15
18
13
19
11
10

3
16
15
15
15
18
13
19
11
10

MICROTIP CATHODE WITH RESISTIVE LAYER

This is a Continuation of application Ser. No. 08/511,261, filed Aug. 4, 1995, now U.S. Pat. No. 5,808,403.

BACKGROUND OF THE INVENTION

1. Field of the Invention

The present invention relates to the fabrication of a cathode including microtips. It more particularly relates to the fabrication of a cathode including microtips for a flat display screen.

2. Discussion of the Related Art

FIG. 1 represents the structure of a flat display screen with microtips of the type used according to the invention.

Such microtip screens are mainly constituted by a cathode 1 including microtips 2 and by a gate 3 provided with holes 4 corresponding to the positions of the microtips 2. Cathode 1 is disposed so as to face a cathodoluminescent anode 5, formed on a glass substrate 6 that constitutes the screen surface.

The operation and the detailed structure of such microtip screens are described in U.S. Pat. No. 4,940,916 assigned to Commissariat à l'Energie Atomique.

The athode conductors are disposed in columns onto a glass substrate 10. The microtips 2 are fabricated on a resistive layer 11 that is deposited onto the cathode conductors, and are conventionally disposed inside meshes defined in the cathode conductors. FIG. 1 partially represents the inside of a mesh, without the cathode conductors. Cathode 1 is associated with gate 3 which is arranged in rows. The intersection of a row of gate 3 with a column of cathode 1 defines a pixel.

This device uses the electric field generated between cathode 1 and gate 3 so that electrons are transferred from microtips 2 toward phosphor elements 7 of anode 5. In the case of a color screen, such as represented in FIG. 1, the anode 5 is provided with alternate strips of phosphor elements 7, each corresponding to a color (red, green, blue). The strips are separated one from the other by an insulating material 8. The phosphor elements 7 are deposited onto electrodes 9, which are constituted by corresponding strips of a transparent conductive layer such as indium and tin oxide (ITO). The group of red, green and blue strips are alternatively biased with respect to cathode 1 so that the electrons extracted from the microtips 2 of one pixel of the cathode/gate are alternatively directed toward the facing phosphor elements 7 of each color.

FIGS. 2A–2D illustrate an exemplary structure of this type, FIGS. 2B and 2D being enlarged portions of FIGS. 2A and 2C, respectively. A plurality of microtips 2, for example 16, are disposed in each mesh 12 defined by the cathode conductors 13 (FIG. 2B). Here, the intersection of a row 14 of gate 3 with a column 15 of cathode 1 corresponds to 64 meshes 12 of a cathode pixel (FIG. 2A).

Cathode 1 is generally constituted by layers successively deposited onto the glass substrate 10. FIGS. 2C and 2D are partial cross-sectional views along line A–A' of FIG. 2B. A conductive layer 13, for example made of niobium, is deposited onto the substrate 10. The layer 13 is etched according to a column pattern 15, each column defining meshes 12 that are surrounded with cathode conductors 13. A resistive layer 11 is then deposited on the cathode conductors 13. The resistive layer 11, constituted for example of phosphor doped amorphous silicon, is intended to protect each microtip 2 against excessive current upon triggering of a microtip 2. The interposition of such a resistive layer 11 aims at homogenizing the electric emission of the microtips 2 of a pixel of cathode 1, thereby increasing the lifetime of cathode 1. An insulating layer 16, made for example, of silicon oxide ($SiO_2$), is deposited onto the resistive layer 11 to insulate the cathode conductors 13 from gate 3 (FIG. 2D). The gate 3 is made of a conductive layer, for example niobium. Holes 4 and wells 17 are etched in layers 3 and 16 respectively to accommodate the microtips 2 that are made, for example, of molybdenum.

The deposition of microtips 2 in wells 17 is conventionally obtained through sputtering of molybdenum onto a lift-off layer deposited on gate 3.

A drawback of conventional techniques is that, although the resistive layer protects the microtips against overcurrents, it cannot fully homogenize the electron emission. In fact, all the microtips of a given mesh are not equidistant from the cathode conductors, which causes a lack of uniformity of the electron mission.

A further drawback lies in the difficulty of forming a meshed structure in the cathode columns. This imposes the fabrication of a complex pattern onto the whole cathode surface.

In addition, the small diameter of the microtips (ranging from 1 to 2 $\mu$m) and the need for reproducing them with a high density per pixel (several thousand per pixel) causes a limitation of the possible surface area of the flat display screens. The differences that may occur in the regularity of the diameter of the holes and wells intended to accommodate the microtips are also detrimental for the homogeneity of the electron emission, by causing differences in the diameter and height of the microtips.

SUMMARY OF THE INVENTION

An object of the invention is to avoid the above drawbacks by providing a cathode including microtips supplying an electron radiation with an optimized homogeneity. The invention also aims at avoiding the formation of meshed cathode conductors.

To achieve these objects, the present invention provides a cathode including microtips for flat display screens including a substrate, at least one cathode conductor, and microtips that are disposed onto a resistive layer. The cathode conductor is disposed above the resistive layer 11 and has circular apertures in the middle of each of which a microtip is disposed.

According to an embodiment of the invention, the diameter of a circular aperture of the cathode conductor is larger than the diameter of a microtip base.

According to an embodiment of the invention, the cathode is associated with a gate, which is separated from the cathode conductor by an insulating layer and is provided with a hole in front of each microtip. The insulating layer and the cathode conductor are provided with wells for accommodating microtips in front of each gate hole. The diameter of the gate hole is substantially smaller than the diameter of the wells of the insulating layer and of the cathode conductive layer.

According to an embodiment of the invention, the cathode includes an auxiliary insulating layer, between the cathode conductor and the insulating layer.

The invention further relates to a method for fabricating a cathode including microtips which consists of performing, over a pile constituted by at least a substrate, a resistive layer, a cathode conductive layer, an insulating layer and a gate layer, an anisotropic etching of holes in the gate layer, and a corresponding etching of larger wells in the insulating layer and the cathode conductive layer under each hole.

According to an embodiment of the invention, the method consists of carrying out the following phases:

forming cathode conductors arranged in columns onto a resistive layer that is disposed onto a substrate;

photoetching circular patterns in the gate rows;

etching holes in the gate rows, and corresponding wells in the insulating layer and the cathode conductive layer, and depositing a microtip in the middle of each well, onto a resistive layer.

According to an embodiment of the invention, the first phase of forming cathode conductors comprises the following steps:

depositing a resistive layer on a substrate;

depositing over the whole plate a thin conductive etch-stop layer;

depositing over the whole plate a conductive layer of cathode conductors;

electrolytically oxidizing the conductive layer of cathode conductors;

simultaneously etching the cathode conductive layer and the auxiliary insulating layer that is obtained by the above oxidation, according to a column pattern; and removing the etch-stop layer between the columns defined by the cathode conductors.

According to an embodiment of the invention, the second phase of photoetching circular patterns is carried out by depositing a resist layer onto the gate layer, and by insolating the resist layer, after deposition of calibrated microbeads that are opaque to the insolation radiation.

According to an embodiment of the invention, a pre-insolation of the resist layer is carried out, prior to the step of depositing microbeads, by masking the gate rows.

According to an embodiment of the invention, the third phase for fabricating the gate and the microtips includes the following steps:

anisotropically and simultaneously etching holes in the gate layer and well preforms in the insulating and cathode conductor layers;

enlarging the wells through isotropic etching;

depositing microtips in the middle of each well, onto the thin conductive etch-stop layer;

removing the etch-stop layer at the bottom of the wells about the microtips.

Thus, according to an embodiment of the invention, the access resistance between the cathode and each microtip is constant since it corresponds to an annular resistive region having a constant size.

The foregoing and other objects, features, aspects and advantages of the invention will become apparent from the following detailed description of the present invention when taken in conjunction with the accompanying drawings.

For the sake of clarity, the various drawings a-re not drawn to scale.

DETAILED DESCRIPTION

Figure 1:
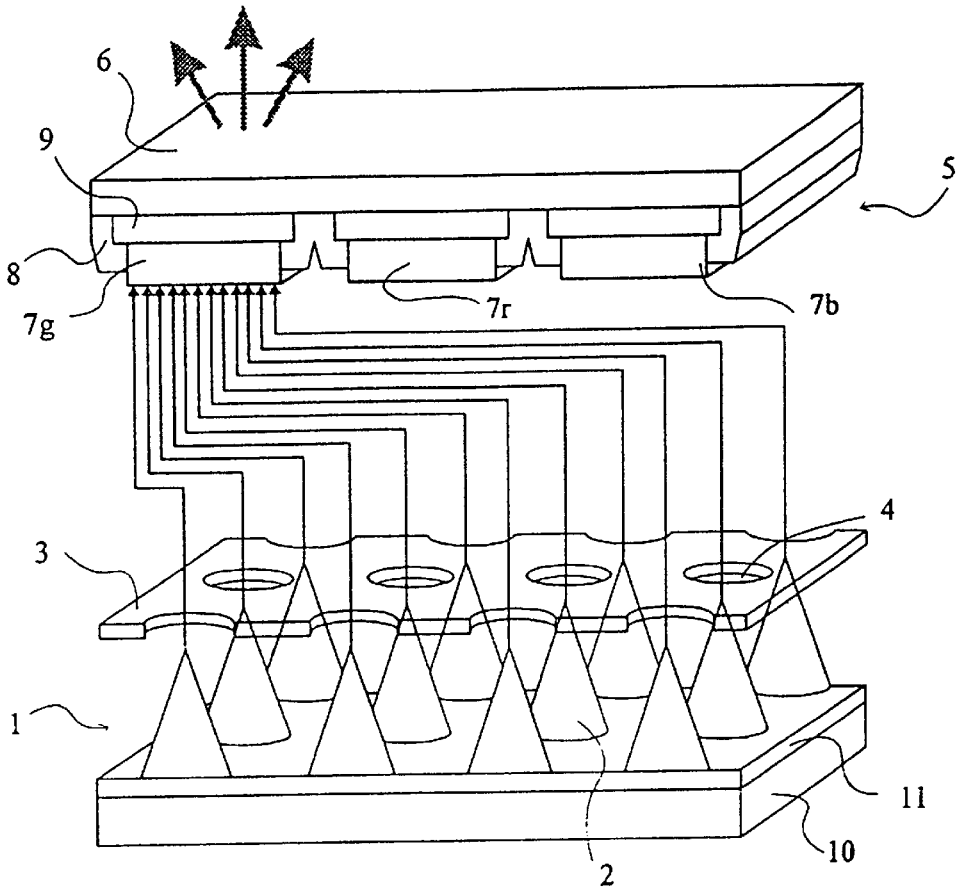
Fig 1 (PRIOR ART)
FIGS. 1 and 2A–2D, above described, explain the state of the art and the problem encountered.
Figure 3A:
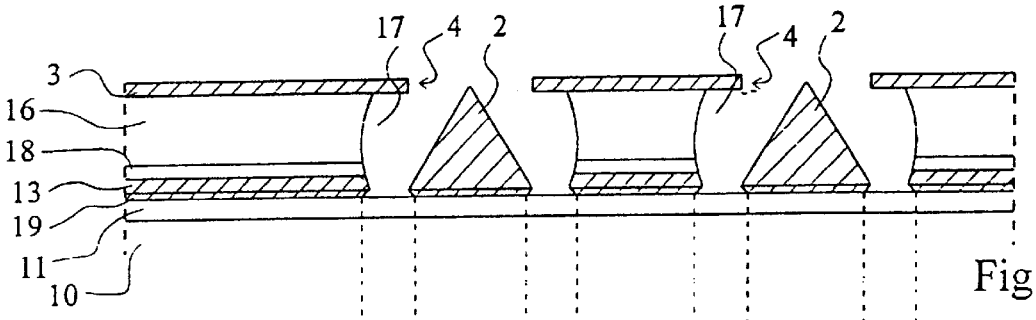
FIGS. 3A and 3B partially represent, respectively according to a top view and according to a cross-sectional view, a cathode including microtips according to the invention.
Figure 3B:
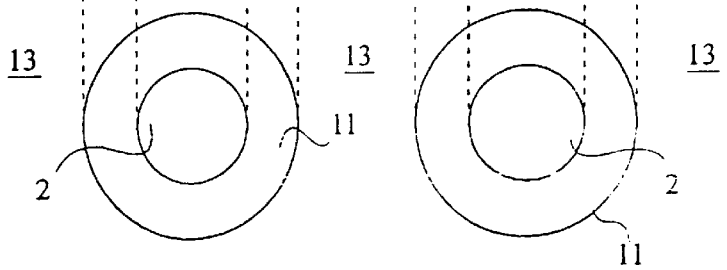
Figure 2B:
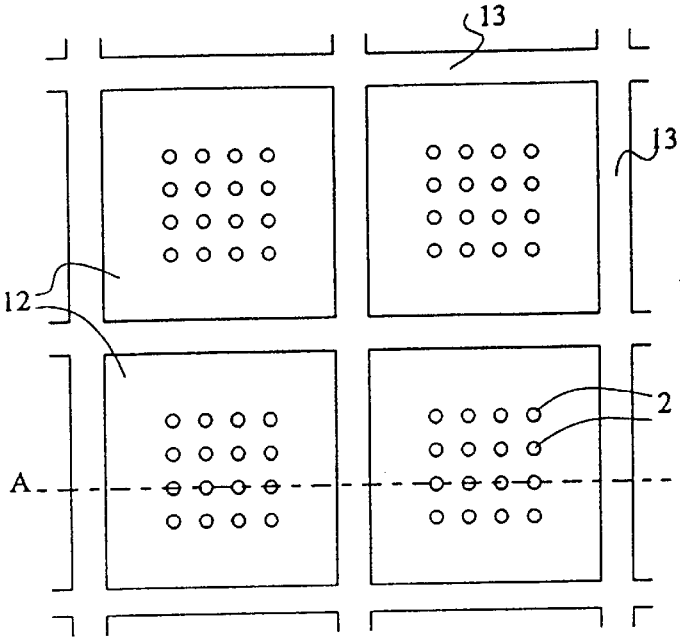
Fig 2B (PRIOR ART)
Figure 2A:
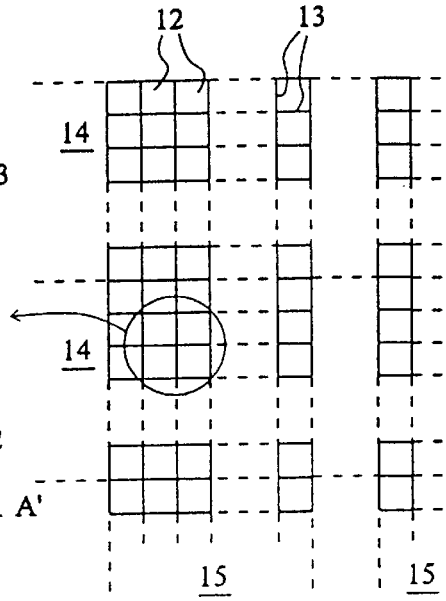
Fig 2A (PRIOR ART)
Figure 2C:
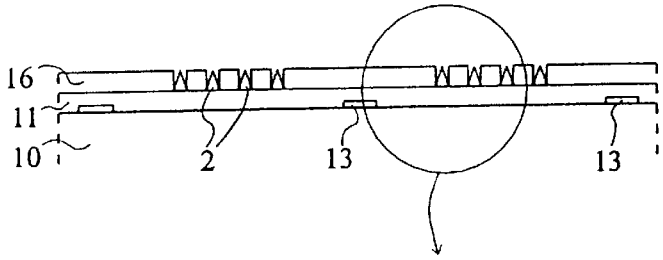
Fig 2C (PRIOR ART)
Figure 2D:
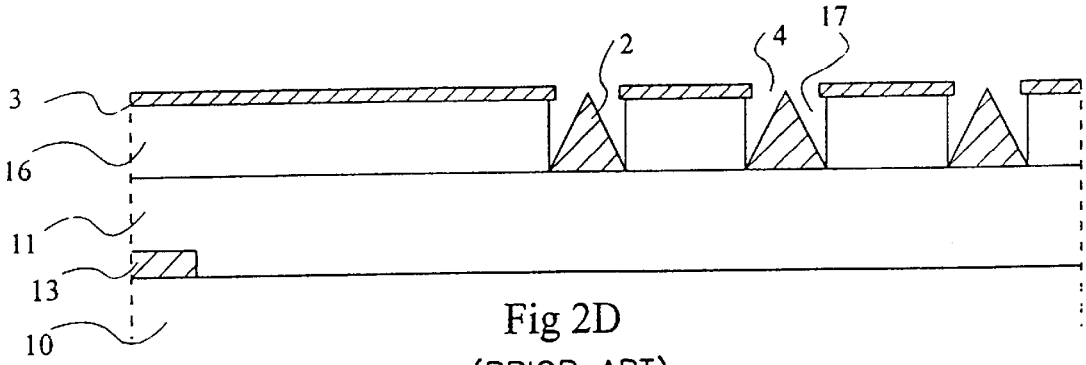
Fig 2D (PRIOR ART)
Figures 4A, 4B, 4C, 4D, 4E, 4F, 4G, 4H:
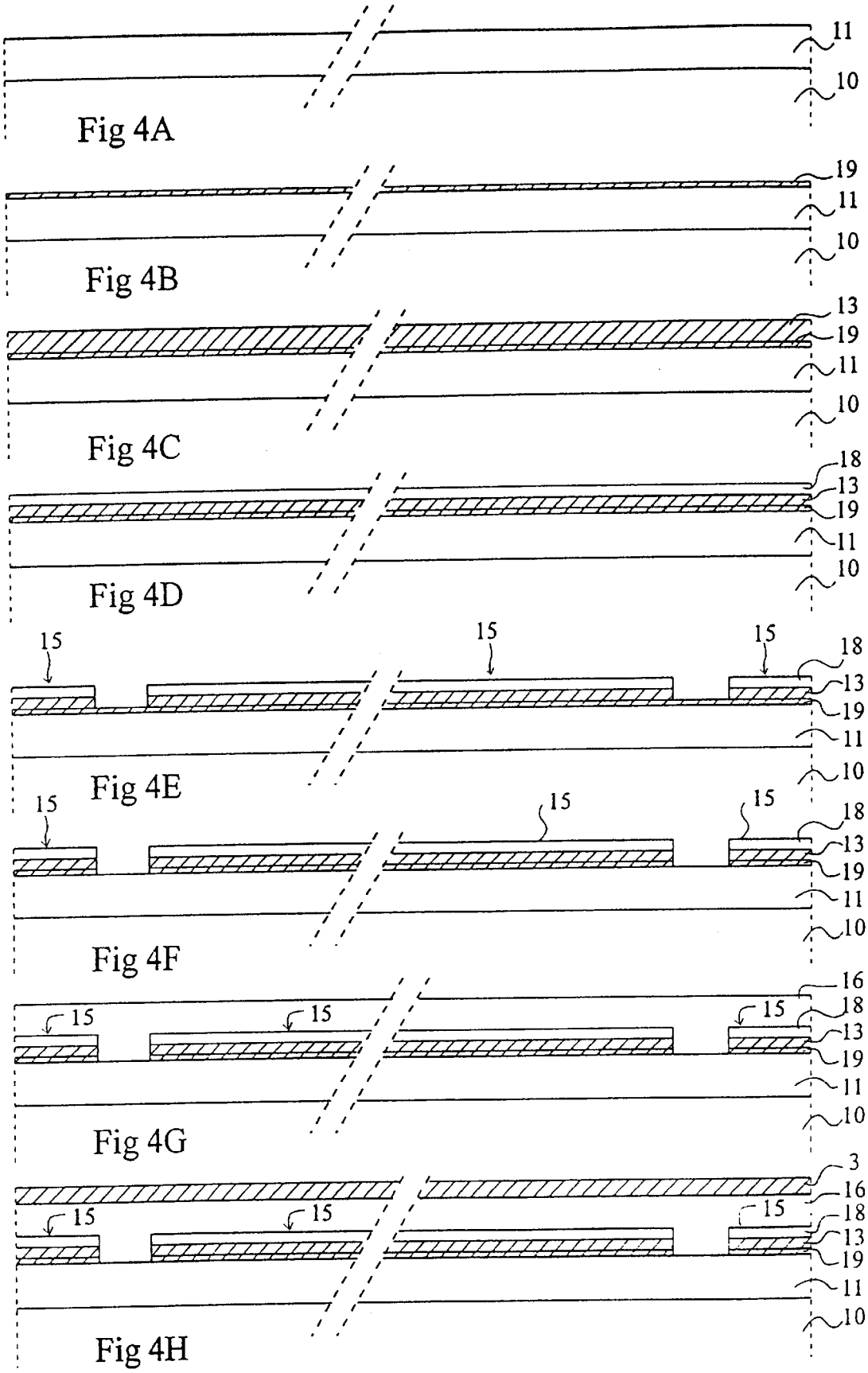
FIGS. 4A–4H are schematic cross-sectional views at various steps of an embodiment of a first phase of a manufacturing process of a cathode according to the invention.

The cathode 1, according to the invention, such as represend in FIGS. 3A and 3B, includes, from an insulating substrate 10, a resistive layer 11 bearing microtips 2. Cathode conductors 13 are disposed on the resistive layer 11 with interposition of a thin conductive layer 19 for improving adherence and providing an etch-stop, if required. The cathode conductors 13 are arranged in columns, each of which includes a large number of microtips, FIG. 3A representing only a small portion of a column. In other words, the cathode conductors 13 are continuous along all columns 15.

Microtips 2 are disposed over the resistive layer 11 in the middle of circular wells 17 provided in each cathode conductor 13. Each circular well 17 defines between the microtip 2 that it receives and the cathode conductors 13 an annular resistive region through layer 11. Thus, all the microtips 2 of the cathode conductor 13 are electrically isolated from the cathode conductor 13, through a resistive region having the same value, provided that the diameter of the circular wells 17 is identical. The diameter of the circular wells 17 is larger than the diameter of the bases of microtips 2.

Thus, all the microtips 2 are electrically isolated from the cathode conductors 13 through a resistance having the same value. This is an essential feature of the present invention that optimizes the homogeneity of the irradiation from each cathode microtip, by providing an homogenous current in the microtips 2.

According to an embodiment illustrated in FIG. 3A, the cathode 1 is associated with a control gate 3. The cathode conductors 13 are then isolated from gate 3 through an insulating layer 16, that may be associated with an auxiliary insulating layer 18. When provided, the auxiliary insulating layer 18 is disposed between the conductor of cathode 13 and the insulating layer 16, and suppresses <<needle holes >> effects that may affect the insulating layer 16 perpendicularly to the surface of the cathode conductors 13.

Holes 4 are provided in the gate layer 3, and wells 17 are provided in the insulating layer 16 and the cathode conductive layer 13 (and, if provided, in the auxiliary insulating layer 18) in order to accommodate the microtips 2. The wells 17 in the insulating layer 16 (and 18) and in the cathode conductor 13 have a diameter that is substantially larger than the holes 4 in the gate layer 3.

Microtips 2 are deposited, on the thin conductive layer 19, if provided, so as to face holes 4. Then, layer 19 is etched away around each microtip 2. Thus, each microtip 2 is laterally separated from the conductive cathode layer 13 by means of a ring having a width that approximately corresponds to the difference between the diameters of wells 17 and holes 4. If the thin conductive layer 19 is not used, the microtips 2 are directly disposed on the resistive layer 11 and are still circularly separated from the cathode conductors 13.

According to an exemplary embodiment, the cathode conductors 13 have a width of approximately 300 $\mu$m, corresponding to the width of one pixel of the screen, defined by the intersection of a row 14 of gate 3 and a column 15 of cathode 1. The diameter of holes 4 is 1.3 $\mu$m, the diameter of wells 17 is 2.6 $\mu$m, and the diameter of each microtip 2 at the base is 1.1 $\mu$m.

An exemplary implementation of the fabrication method of such a cathode according to the invention will be described hereinafter.

This method can be implemented in three phases, respectively corresponding to the fabrication of the cathode conductors 13, to the formation of patterns at the subsequent positions of the microtips 2 in the gate rows 3, and to the fabrication of gate 3 and microtips 2.

FIGS. 4A–4H illustrate an implementation of the first phase that corresponds to the fabrication of the cathode conductors 13.

During a first step (FIG. 4A), a resistive layer 11 is deposited onto substrate 10.

A second step (FIG. 4B) consists of depositing a thin conductive etch-stop layer 19. Layer 19 plays two roles. On the one hand, it constitutes an anchoring surface for the next layer (FIG. 4C) and microtips 2. On the other hand, it ensures an etch-stop for the cathode conductors 13. This second role will be better understood later on, with relation to the description of FIGS. 4E and 6A–6C.

A third step (FIG. 4C) consists of depositing a conductive layer 13. The anchoring of layer 13 is enhanced by layer 19.

A fourth possible step (FIG. 4D) consists of oxidizing the conductive layer 13 to obtain, in the thickness of layer 13, an auxiliary isolating layer 18. Layer 13 is then selected so as to be oxidable. Also, care should be taken so that the thickness of layer 13, deposited during the third step, is sufficient to obtain an auxiliary isolating layer 18 while maintaining a sufficient thickness for the cathode conductors 13.

The four steps described above are achieved onto the whole surface of substrate 10.

During a fifth step (FIG. 4E), the cathode conductors 13 are etched in columns. Layer 19 ensures, during this step, that etching is stopped, which prevents the resistive layer 11 from being etched. The cathode conductors 13 have, for example, a width of approximately 300 $\mu$m.

Then, during a sixth step (FIG. 4F), layer 19 is removed at positions where layers 13 and 18 have been etched, i.e., between columns 15 of the cathode conductors 13.

During a seventh step (FIG. 4G), an insulating material 16 is deposited on the structure formed during the first phase.

During an eighth step (FIG. 4H) a gate conductive layer 3 is deposited. The deposition is, for example, obtained in the same way as the deposition of the cathode conductors 13.

As can be seen, the structure thus obtained according to the invention differs from the prior art structures, especially by the fact that the conductive layer 13 is no longer etched according to a pattern of meshed columns, and by the fact that the cathode conductors 13 are continuous onto a column 15.

In addition, the resistive layer 11 is deposited before the conductive layer 13, which allows the formation of an auxiliary insulating layer 18 by oxidizing the conductive layer 13.

Figure 5A:
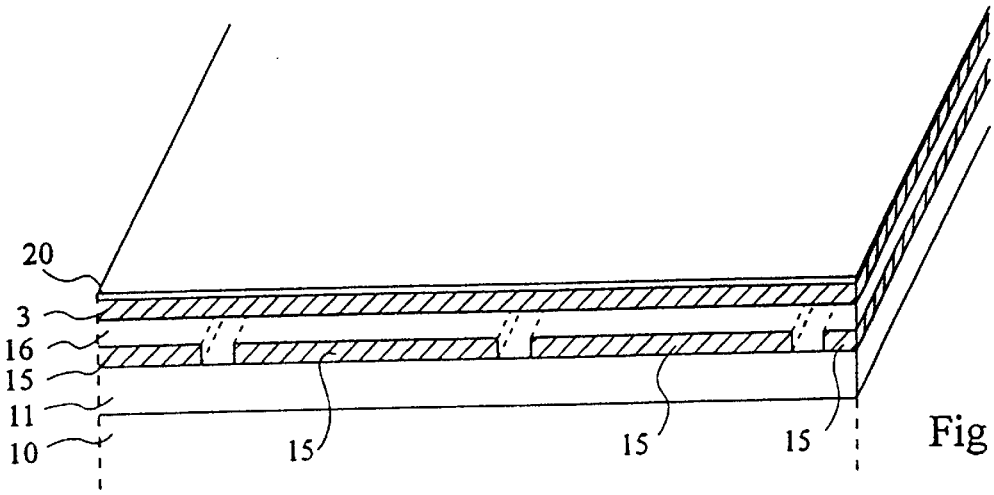
FIGS. 5A–5C are schematic cross-sectional views of various steps of an embodiment of a second phase of a manufacturing process of a cathode including microtips according to the invention.
Figure 5B:
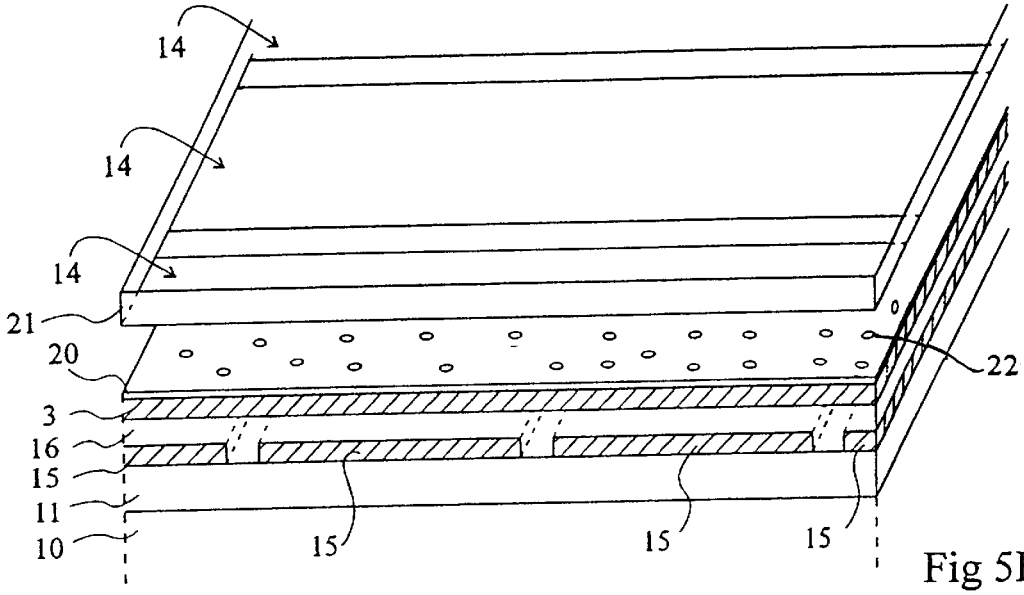
Figure 5C:
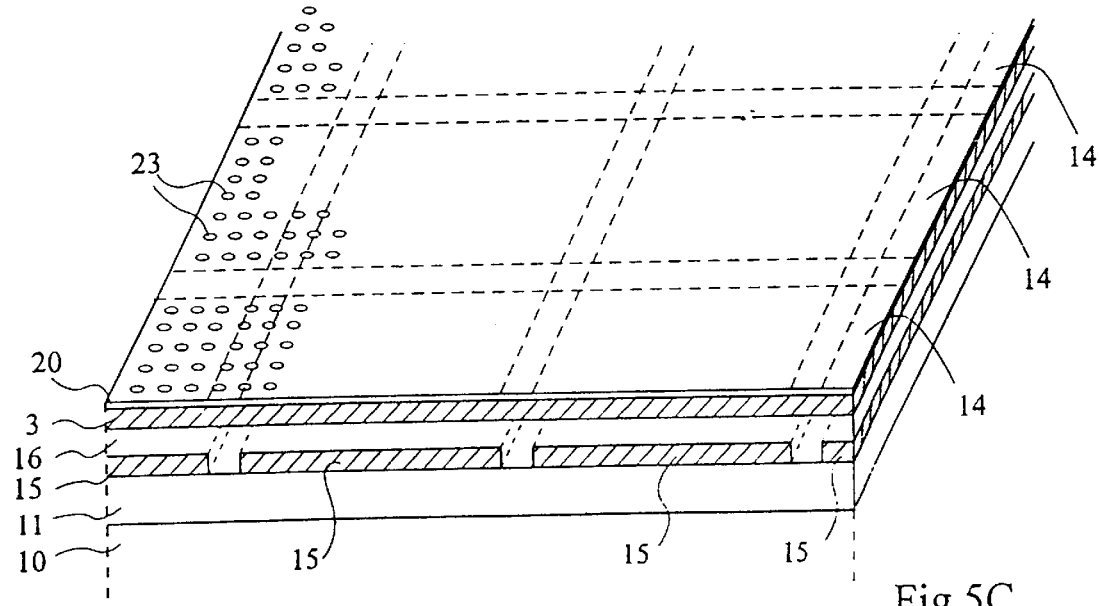

FIGS. 5A–5C illustrate a second phase of the method for fabricating a cathode including microtips according to the invention, corresponding to a phase of delineating the gate rows and forming patterns at the subsequent positions of the microtips in the rows of gate 3. For the sake of clarity, layers 13, 18, and 19 of the pile formed during the first phase are designated, in FIGS. 5A–5C, by the common reference 15 corresponding to their column design.

The second phase uses a photoetching of circular patterns to define the subsequent positions of the microtips, i.e., holes 4 in the gate rows 3.

During a first step (FIG. 5A), a negative photoresist layer 20 is applied on the conductive layer 3.

Any conventional photoetching method can be used to define circular patterns in layer 20 as well as gate rows 3. The width of the gate rows is, for example, approximately 300 $\mu$m. The diameter of a circular pattern has a determined value ranging, for example, from 1 to 2 $\mu$m, and the number of patterns is several thousand per pixel.

However, it is preferable to use a specific phase for photoetching circular patterns that ensures the formation of patterns having a regular diameter and a regular density, independently of the screen size, in order to further optimize the homogeneity of the electron emission.

During a second step (FIG. 5B), the resist layer 20 is pre-insolated through a conventional mask 21 for defining rows 14 of gate 3.

Then, during a third step (not shown), microbeads 22 are deposited on the resist layer 20. The microbeads 22 are, for example, made of glass or plastic. They are opaque to the insolation radiation in order to provide a maximum masking effect of the areas on which they are deposited. The microbeads 22 are randomly distributed on the resist layer 20. It has been noticed that the quality of the screens depends upon the regularity of the distribution of the microtips 2 from one pixel to another, and upon the regularity of the diameter of the microtips 2. In contrast, the distance between two microtips 2 does not affect the quality of the screens provided that the density of the microtips is high. Thus, the random distribution of the patterns in the gate layer 3 has no consequence on the quality of the screens. It has thus been noticed that a flat screen of good quality is obtained with a number and a diameter of circular patterns in each pixel that are the same with a tolerance of 5%, the pattern density of a pixel being high in order to not impair the brightness of the screen. The deposition of calibrated microbeads 22 having a determining diameter ranging from 1 to 5 $\mu$m with a tolerance of 10% for the diameter of the microbeads 22 makes it possible to obtain this result.

To make sure that the density of the microbeads 22 that are deposited on layer 20 is sufficient and regular, several methods for depositing the microbeads 22 can be used, according to the invention.

A first method consists of immersing the pile formed during the first phase, coated with the resist layer 20, into a bath containing microbeads 22 in solution. The density of the microbeads 22 in the bath is determined as a function of the desired density of patterns. The deposition of microbeads 22 is made by decantation, the microbeads used in this case are made of glass. Moreover, it is possible to carry out the insolation step through the bath as soon as the microbeads 22 have decanted, which accelerates the execution of the method. The evacuation of the microbeads 22, after insolation, is made in this case by simply removing the pile and its support, if provided, out of the bath.

A second method consists of sputtering, on the resist layer 20, a mixture of solvent and microbeads 22 contained in a tank. The solvent includes alcohol, which allows its evaporation during sputtering. The distribution of the microbeads 22 onto the resist layer 20 has a good homogeneity, because the density of the microbeads 22 is determined by the time duration of the sputtering. In this case, the microbeads 22 are held on the resist layer 20 through electrostatic effect, resulting from the charges acquired when they pass through air between a sputtering nozzle and the resist layer 20. The evacuation of the microbeads 22 after insolation should be made by blowing or any other suitable means. An advantage of this technique is that a repulsive force is generated between the microbeads 22, due to their charge, which tends to improve the regularity of their distribution.

A third method consists of immersing microbeads 22 in a viscous material, for example polyvinyl-alcohol. The resist layer 20 is covered with a layer of this material, for example by scraping or serigraphy without pattern. The polyvinyl-alcohol is then dried, then insolation is carried out in a manner that will be described hereinafter. Subsequently, the polyvinyl-alcohol is dissolved, for example in water, and the microbeads 22 are simultaneously evacuated.

Once the microbeads 22 are deposited on the resist layer 20, the resist layer 20 is insolated by means of a quasi-parallel light insolator during a fourth step (not shown). The wavelength of the insolating radiation is selected as a function of the resist that is used and of the desired accuracy, for example in the range of ultraviolet radiation. The microbeads 22 are then evacuated from the resist layer 20 during a fifth step (not shown).

Isolation is effective only in the surfaces that were masked during the second pre-insolation step, i.e., inside rows 14 of gate 3 that were formed. Thus, during the development of resist by means of a conventional method (FIG. 5C), patterns 23 are obtained in the resist layer 20 only in the surface of rows 14 of gate 3. This makes it possible to position the areas of the microtips 2 of cathode i, by limiting the formation of patterns 23 to surfaces corresponding to areas for accommodating the microtips 2. In FIG. 5C, the pattern of the columns 15 of the cathode conductors 13, is represented in dot-and-dash line, and the pattern of the pre-insolated surfaces 14, corresponding to rows 14 of gate 3, is represented in dotted lines.

During a sixth step (FIG. 5C), the resist is developed by any conventional method under conditions compatible with the type of resist that is used. Circular patterns are thus formed in the resist layer 20 at the positions of microbeads 22. The patterns 23 are then used to etch holes 4 and correspond to well preforms 17 in layers 3, 16, 18, and 13, of the pile formed during the first phase, as will be seen hereinafter with relation to FIGS. 6A–6C.

An alternative insolation step consists of insolating the resist layer 20, still with a quasi-parallel light insolator, and of tilting layer 20 with respect to the beam axis, and rotating layer 20 about this axis. To achieve this purpose, the pile formed during the first phase and coated with the resist layer 20 on which the microbeads 22 have been disposed is, for example, laid on a rotating support that is tilted by a predetermined angle with respect to the axis of the beam. Thus, the diameter that is effectively insolated around each microbead 22 is smaller than the diameter of the microbeads 22. Thus, the diameter of patterns 23 are smaller than the diameter of the microbeads 22. The ratio between the diameter of the microbeads 22 and the diameter of the obtained pattern 23 depends upon the tilt angle of the support with respect to the axis of the quasi-parallel radiation beam of the insolator. This alternative embodiment further improves the resolution obtained by implementing the method according to the invention. Hence, it is possible to use larger microbeads 22 that have a better uniformity. It is for example possible to make patterns 23 having a diameter of 2 $\mu$m by means of microbeads 22 having a diameter of 5 $\mu$m.

Figure 6A:
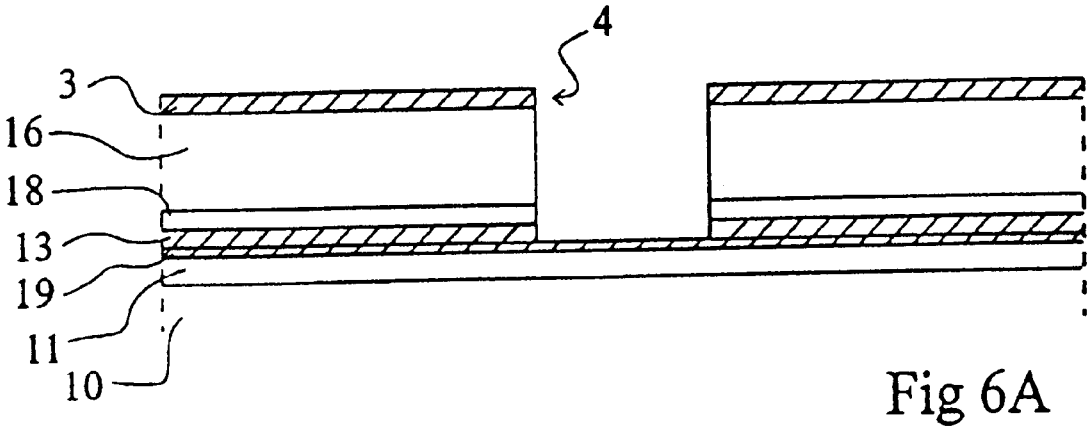
FIGS. 6A–6C are schematic cross-sectional views of various steps of an embodiment of a third phase of a manufacturing process of a cathode including microtips according to the invention.
Figure 6B:
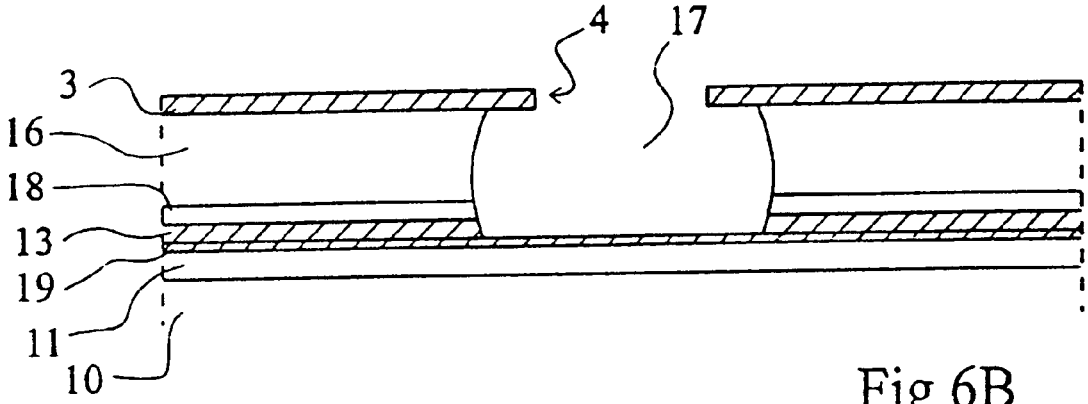
Figure 6C:
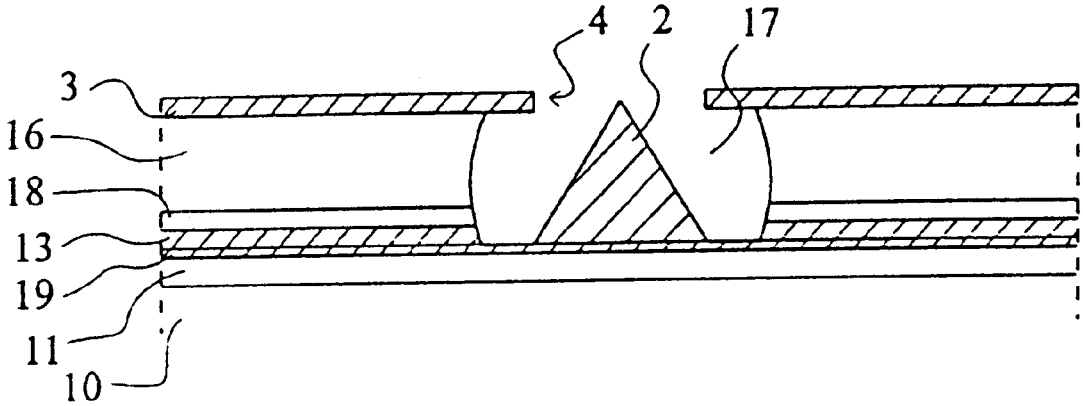

FIGS. 6A–6C illustrate an exemplary embodiment of a third phase of the method according to the invention. This third phase corresponds to the formation of holes 4 in rows 14 of gate 3, and to the deposition of microtips 2 in wells 17 facing holes 4. For the sake of clarity, the drawings of FIGS. 6A–6C represent a portion of a pixel defined by the intersection of a row 14 of gate 3 with a column 15 of cathode 1.

During a first step (not shown), gate rows 14 are etched in the gate layer 3, as well as holes 4 at the subsequent positions of the microtips 2, i.e., at the positions of patterns 23. The etching of this first step is achieved so as to etch the material of gate 3 without etching the material of the insulating layer 16. Moreover, etching is preferably anisotropic.

During a second step (FIG. 6A) a reactive ion etching is carried out up to the etch-stop layer 19. Thus, wells 17 are etched in the insulating layer 16 (and 18, if provided) and in the cathode conductors 13. Etching is anisotropic so that the wells 17 are lined up with the circular patterns 23. The diameter of wells 17 is, for example, 1.3 $\mu$m like holes 4.

During a third step (FIG. 6B) the diameter of wells 7 is increased in the insulating layers 16 (and 18, if provided) and in the cathode conductors 13. To achieve this purpose, an isotropic wet etching is carried out.

Etchings of the second and third steps are stopped by the etch-stop layer 19 in order to not etch the resistive layer 11 on which the microtips 2 should be deposited. The etching of rows 14 of gate 3 (first step) could also be carried out prior to the second phase. In this case, the reactive ion etching of the second step (FIG. 6A) can be carried out, at the positions of patterns 23, simultaneously in layers 3, 16 (and 18, if provided), and 13. So, holes 4 and wells 17 are simultaneously formed. Moreover, the pre-insolation step (FIG. 5B) of the second phase is then no longer necessary since the gate rows are already formed. In contrast, this pre-insolation step could be used to limit the formation of patterns 23 facing the cathode conductors 13, inside columns 15.

The microtips 2 are conventionally deposited during a fourth step (not shown). One uses, for example, a lift-off layer on which a conductive material is evaporated. This evaporation allows both the formation of a residual layer on the lift-off layer and the formation of microtips 2 in wells 17. The microtips 2 have, for example, a base diameter of 1.1 $\mu$m and a height of approximately 1.2 $\mu$m. Then, the residual layer is removed by means of the lift-off layer. A structure such as the one represented in FIG. 6C is then obtained.

During a fifth and last step, the etch-stop layer 19 surrounding the microtips 2 is removed. This removal causes the formation between each microtip 2 and a cathode conductor 13, through the resistive layer 11, of an annular resistor having the same value for all the microtips 2.

Thus, a cathode such as represented in FIGS. 3A and 3B is provided.

An exemplary implementation of a cathode including microtips is described hereinafter with specification of the materials of etching types that are used.

Phase 1:

Step 1: depositing a resistive layer 11, through sputtering of phosphor-doped amorphous silicon, onto the glass substrate 10. The thickness of the resistive layer 11 is, for example, 0.3 $\mu$m.

Step 2: depositing, through evaporation of chromium, a thin conductive layer 19. The thickness of layer 19 is, for example, 0.025 $\mu$m.

Step 3: depositing, through evaporation of niobium, a layer of cathode conductors 13. The anchoring of layer 13 is enhanced by layer 19, because anchoring of niobium on amorphous silicon is hazardous. The thickness of the conductive layer 13 ranges, for example, from 0.2 to 0.4 $\mu$m.

Step 4: oxidizing layer 13 over the whole plate. Oxidation is, for example, obtained by subjecting the niobium layer 13 to an anodic oxidation in a solution including ammonium pentaborate and ethyleneglycol. For this purpose, the pile is placed as an anode in a electrolytic bath of ammonium pentaborate and ethyleneglycol. The oxidation thickness depends practically only upon the voltage at which electrolyzing is achieved. With a 40-V voltage, for example, a thickness of niobium pentoxide ($Nb_2O_5$) of 0.12 $\mu$m is obtained, which constitutes an auxiliary insulating layer 18.

Step 5: etching in a plasma of sulfur hexafluoride ($SF_6$) the insulating layer 18 and the conductive layer 13, in a pattern of columns 15. Plasma etching is preferably achieved because a chemical (wet) etching of niobium pentoxide ($Nb_2O_5$) which constitutes layer 18 is difficult to control. In contrast, this oxide is etched in the same plasma as the one conventionally used to etch niobium. The used plasma also etches amorphous silicon; that is why layer 19 is referred to as an etch-stop layer and is formed in a material selected to be difficult to etch in a plasma of sulfur hexafluoride.

Step 6: eliminating layer 19, between columns 15, through masking and chemical etching including potassium permanganate ($KMnO_4$) and potassium hydroxide (KOH) which etches the evaporated chromium without damaging the adjacent layers.

Step 7: CVD depositing under normal pressure an insulating layer 16 of silicon oxide ($SiO_2$). The thickness of the insulating layer 16 is, for example, 1.3 $\mu$m.

Step 8: depositing a conductive gate layer 3, through niobium evaporation. The thickness of the gate layer which corresponds to the thickness of gate 3 ranges, for example, from 0.2 to 0.4 $\mu$m.

Phase 2:

Step 1: depositing a photoresist layer 20.

Step 2: pre-insolating rows 14 of gate 3 through a mask.

Step 3: randomly depositing calibrated microbeads 22 onto the resist layer 20.

Step 4: insolating the resist layer 20 coated with microbeads

Step 5: evacuating the microbeads 22.

Step 6: developing resist 20, and obtaining patterns 23 at the subsequent positions of microtips 2 in rows 14 of gate 3.

Phase 3:

Step 1: etching in a plasma of sulfur hexafluoride ($SF_6$) layer 3 according to a pattern of rows 14, and holes 4 at the positions of patterns 23. The plasma is selected so as to etch the niobium of layer 3 without etching the silicon dioxide ($SiO_2$) which constitutes the insulating layer 16.

Step 2: resistive ion etching of well preforms 17 in the insulation layers 16 and 18, and of cathode conductors 13, facing holes 4 in gate 3. The etching is selected so as to be anisotropic.

Step 3: isotropic chemical etching of wells 17 in the insulation layers 16 and 18, and of cathode conductors 13.

Step 4: depositing a lift-off layer, by electrolytically depositing nickel onto the remaining surfaces of the gate layer 3. Forming microtips 2 through molybdenum evaporation. Then, eliminating the molybdenum residues with the lift-off layer.

Step 5: etching layer 19 in its free surface, for example through masking and a chemical bath including potassium permanganate ($KMnO_4$) and potassium hydroxide (KOH).

As is apparent to those skilled in the art, various modifications can be made to the above disclosed preferred embodiments. In particular, each layer component described above can be replaced with one or more components having the same characteristics and/or having the same function. In addition, the etching means described by way of example can be replaced with other dry or wet etching means providing the same result.

Similarly, the succession of exemplary steps can be modified as a function of the materials and etching means. For example, the step of forming the auxiliary insulating layer 18 (phase 1, step 4) can be postponed after etching of the cathode conductors 13, the cathode conductors 13 then having oxidized edges.

The formation of the gate rows 14 can be postponed at the end of the process. In this case, the second step of the second phase is maintained and the surfaces which correspond to the gate rows are pre-Insolated. This prevents patterns 23 from being formed between rows 14, which would suppress the insulating layer 16 at the positions of these patterns. In this case, the first and second steps of the third phase are simultaneously achieved.

In addition, the exemplary size indications can be modified as a function of the desired screen characteristics, of the used materials, or of other requirements. In particular, the diameter of the used microbeads 22 depends upon the desired diameter for holes 4 of gate 3 and upon the insolation (vertical or horizontal) technique that is used.

Having thus described at least one illustrative embodiment of the invention, various alterations, modifications and improvements will readily occur to those skilled in the art. Such alterations, modifications, and improvements are intended to be within the spirit and scope of the invention. Accordingly, the foregoing description is by way of example only and is not intended to be limiting. The invention is limited only as defined in the following claims and the equivalents thereto.

What is claimed is:

1. A cathode (1) including microtips for flat display screens including:

a substrate (10), a resistive layer (11) disposed on said substrate:

at least one cathode conductor (13), and microtips (2) disposed on said resistive layer (11), wherein said cathode conductor (13) has circular wells (17) in the middle of each of which a microtip (2) is disposed whereby said microtips are electrically isolated from said at least one cathode conductor by a constant access resistance.

2. The cathode of claim 1, wherein the diameter of each circular well (17) of the cathode conductor (13) is larger than the diameter of the base of a microtip (2).

3. The cathode of claim 1, associated with a gate (3), which is separated from the cathode conductor (13) by an insulating layer (16) and is provided with a hole (4) in front of each microtip (2); the insulating layer (16) and the cathode conductor (13) being provided with circular wells (17), each well capable of accommodating a microtip (2) in front of each hole (4) of gate (3); and the diameter of the holes (4) of gate (3) being substantially smaller than the diameter of the wells (17) of the insulating layer (16) and of the cathode conductive layer (13).

4. The cathode of claim 3, wherein said circular wells define an annular resistive region in said resistive layer between said microtip and said at least one cathode conductor.

5. The cathode of claim 4, wherein said circular wells have identical dimensions.

6. The cathode of claim 5, wherein said annular resistive region defined by said circular wells and said identical dimensions of said circular wells provide constant access resistance for the cathode.

* * * * *